US009533181B2

(12) United States Patent
Popp

(10) Patent No.: US 9,533,181 B2
(45) Date of Patent: Jan. 3, 2017

(54) MULTI-CLASS FIRE EXTINGUISHING AGENT

(71) Applicant: James B. Popp, Olive Branch, MS (US)

(72) Inventor: James B. Popp, Olive Branch, MS (US)

(73) Assignee: Federal Express Corporation, Memphis, TN (US)

( * ) Notice: Subject to any disclaimer, the term of this patent is extended or adjusted under 35 U.S.C. 154(b) by 0 days.

(21) Appl. No.: 14/669,752

(22) Filed: Mar. 26, 2015

(65) Prior Publication Data

US 2015/0196787 A1 Jul. 16, 2015

Related U.S. Application Data

(63) Continuation of application No. 11/884,953, filed as application No. PCT/US2006/006481 on Feb. 24, 2006, now Pat. No. 9,050,480.

(60) Provisional application No. 60/656,436, filed on Feb. 25, 2005.

(51) Int. Cl.
*A62D 1/02* (2006.01)

(52) U.S. Cl.
CPC ..... *A62D 1/0071* (2013.01)

(58) Field of Classification Search
CPC ..... A62D 1/0071; A62C 99/0009; A62C 99/0018; A62C 99/0036
See application file for complete search history.

(56) References Cited

U.S. PATENT DOCUMENTS

| | | | | |
|---|---|---|---|---|
| 3,738,428 | A * | 6/1973 | Ingro | 169/61 |
| 3,802,511 | A | 4/1974 | Good, Jr. | |
| 4,254,833 | A | 3/1981 | Perry | |
| 4,951,754 | A | 8/1990 | Solheim | |
| 4,981,178 | A | 1/1991 | Bundy | |
| 5,056,602 | A | 10/1991 | Tapscott et al. | |
| 5,069,290 | A * | 12/1991 | Brotz | 169/45 |
| 6,267,183 | B1 | 7/2001 | Smagac | |
| 6,988,558 | B2 * | 1/2006 | Araki et al. | 169/46 |
| 7,153,446 | B2 * | 12/2006 | Grigg | 252/3 |

OTHER PUBLICATIONS

International Preliminary Report on Patentability (Chapter I of the Patent Cooperation Treaty) regarding PCT/US2006/006481, dated Aug. 28, 2007.
Written Opinion of the International Searching Authority regarding PCT/US06/06481, dated Feb. 26, 2007.
International Search Report regarding PCT/US06/06481, dated Nov. 9, 2006.

* cited by examiner

*Primary Examiner* — Ryan Reis
(74) *Attorney, Agent, or Firm* — Finnegan, Henderson, Farabow, Garrett & Dunner LLP

(57) ABSTRACT

A fire extinguishing agent may include a foam and at least one inert gas combined with the foam. A method of extinguishing a fire including a burning metal and/or a burning metal compound and also including a burning plastic material and/or a burning paper material may include combining a foam and at least one inert gas to form a fire extinguishing agent, and applying the fire extinguishing agent to the fire.

7 Claims, No Drawings

MULTI-CLASS FIRE EXTINGUISHING AGENT

RELATED APPLICATION

This application is a continuation of U.S. application Ser. No. 11/884,953, filed Aug. 23, 2007, which is a U.S. national phase application filed under 35 U.S.C. §371 based on PCT/US2006/006481, filed Feb. 24, 2006, which claims the benefit of priority under 35 U.S.C. §119(c) of U.S. Provisional Application No. 60/656,436, filed Feb. 25, 2005, the disclosures of which are incorporated herein by reference.

FIELD OF THE INVENTION

The present invention relates to a fire extinguishing agent. In particular, the present invention relates to a fire extinguishing agent for extinguishing multiple classes of fires.

BACKGROUND OF THE INVENTION

Many metals and metal compounds are flammable. When ignited, a metal may act as the fire's fuel and may be oxidized by a number of elements and/or compounds. Most metals prone to ignite may produce fires of extremely high temperatures and may be difficult to extinguish. The classification for fires involving metals and/or metal compounds are commonly known as "Class D" fires. Examples of these metals include, but are not limited to, lithium, sodium, potassium, rubidium, cesium, francium, beryllium, titanium, uranium, and plutonium. Some metal compounds, such as, for example, alkyllithiums, Grignards and diethyizinc, are pyrophoric organometalic reagents. Most pyrophoric organometalic reagents may burn at high temperatures and may react violently with, for example, water, air, and/or other chemicals.

Because these materials react to produce extremely high temperature fires and are natural catalysts, they have the ability to extract oxidizers from their surrounding environment and/or from compounds normally used as fire extinguishing agents. These oxidizing agents are not necessarily oxygen-containing compounds. Many metals, such as, for example, magnesium, sodium, lithium, and potassium, once ignited, will burn in, for example, gases containing nitrogen, chlorine, fluorine, sulfur, and/or sulfur. The gases may disassociate common fire extinguishing agents, such as, for example, carbon dioxide and Halon® to free radicals needed to support their combustion.

One example of how reactive these metals are is demonstrated by the modern aircraft flare. This type of flare is not compounded from traditional oxidizers such as potassium nitrate or potassium chlorate, which are rich in oxygen, but are in fact a mixture of finely powdered magnesium and Teflon®. Teflon® is considered to be one of the least reactive materials known to man and contains no oxygen. Once ignited, however, Teflon® decomposes to release fluorine, which acts as its oxidizing agent. The reaction tends to be more vigorous and tends to produce temperatures hotter than would be possible with oxygen.

When water comes into contact with some of these metals, such as, for example, lithium, sodium, potassium, and magnesium, hydrogen gas is dissociated from the water and a hydroxide radical is formed. The hydrogen gas formed by this reaction is a very combustible gas and may be often ignited by heat generated by the decomposing metal/water reaction. In such reactions, a dangerous situation may result if certain chemicals used in fire extinguishers are applied to certain types (e.g., classes) of fires. In fact, some dangerous situations are sometimes associated with the above reactions. For example, some fire fighting training manuals include warnings such as, for example, the following warning: "It is vital to know what type of extinguisher you are using. Using the wrong type of extinguisher for the wrong type of fire can be life-threatening."

When metals and/or metal compounds are shipped from one location to another, they may often be shipped in containers and/or on pallets with other types of freight, such as, for example, plastic parts and/or paper boxes. The resulting mixture of freight types, if involved in a fire, may likely require different types of fire extinguishing agents in order to effectively extinguish the different classes of fires (e.g., Class A, Class B, and/or Class D fires).

Fire extinguishing agents sometimes used to safely extinguish Class D fires (e.g., those types of fires sometimes associated with metals and/or metal compounds) may not be desirable for extinguishing other classes of fires. As a result, such agents may require adherence to special procedures for effective use, such as the following procedure for using an agent sold under the trade name, "Purple K®": "Apply the dry powder. Completely cover the burning metal with a thin layer of powder. Once control is established, take a position that is in close range. Throttle the stream with the nozzle valve to produce a soft, heavy flow. Cover the metal completely with a heavy layer of powder. Be careful not to break the crust formed by the powder. Slowly open the nozzle of the extinguisher."

When shipping a mixture of types of freight (e.g., metals and/or metal compounds, plastic materials, and/or paper boxes), however, it may not be possible to follow such rules, for example, because it may not be practical to orient the freight in a manner where freight containing metals and/or metal compounds would be positioned in such a way to allow the fire extinguishing agent (e.g., fire extinguishing powder) to cover all exposed sides of that type of freight. For example, if a container of metallic sodium were shipped, it might be loaded high on or in the middle of a built-up pallet load of other freight contained in cardboard boxes. As the cardboard boxes burn during a fire, the freight load might constantly shift and thereby re-expose the burning sodium following coverage with extinguishing powder. Further, because of sodium's low melting point, the sodium might simply melt and run out from under the powdered agent.

Freight shipments sometimes referred to as "Hazardous Freight" shipments may often include a mixture of types of materials. As a result, if such a freight shipment were to catch fire, it might generate various classes of fires (e.g., Class A, Class B, and/or Class D fires). No single conventional fire extinguishing agent, however, exists that is desirable for extinguishing all such classes of fires. In most situations, for example, attempting to extinguish a mixed class fire, including a Class D fire along with a Class A and/or a Class B fire, may be futile due, for example, to the differing needs of fire extinguishing agents for different fire classes. For example, if active elements such as Halon® and/or one of the known Halon® replacement agents are used to extinguish a Class D fire, a dangerous situation might result.

There may exist a need for a fire extinguishing agent that may be used to effectively and/or safely extinguish a fire including burning metals and/or metal compounds. Further, there may exist a need for a fire extinguishing agent that may be used to effectively and/or safely extinguish a fire including burning metals and/or metal compounds along with other types of burning materials.

The invention may seek to satisfy one or more of the above-mentioned needs. Although the present invention may obviate one or more of the above-mentioned needs, it should be understood that some aspects of the invention might not necessarily obviate them.

SUMMARY OF THE INVENTION

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a fire extinguishing agent that may include a foam and at least one inert gas combined with the foam.

As used herein, the term "inert gas" means at least one gas selected from helium, neon, argon, krypton, xenon, and radon in concentrations greater than concentrations naturally occurring in air (e.g., concentrations normally associated with commercially-available bottled, inert gas).

In another aspect, the invention includes a method of extinguishing a fire including a burning metal and/or a burning metal compound. The method may include combining a foam and at least one inert gas to form a fire extinguishing agent, and applying the fire extinguishing agent to the fire.

According to a further aspect, the invention includes a method of extinguishing a fire including a burning metal and/or a burning metal compound and also including a burning plastic material and/or a burning paper material. The method may include combining a foam and at least one inert gas to form a fire extinguishing agent, and applying the fire extinguishing agent to the fire.

In still a further aspect, the invention includes a method of extinguishing a fire including a Class D fire. The method may include combining a foam and at least one inert gas to form a fire extinguishing agent, and applying the fire extinguishing agent to the fire.

In yet another aspect, the invention includes a method of extinguishing a fire including a Class D fire and at least one other class of fire. The method may include combining a foam and at least one inert gas to form a fire extinguishing agent, and applying the fire extinguishing agent to the fire.

DESCRIPTION OF EXEMPLARY EMBODIMENTS

Reference will now be made in detail to some possible embodiments of the invention, examples of which are outlined in this description.

According to one embodiment, a fire extinguishing agent configured to extinguish a Class D fire and one or more other classes of fires such as, for example, a Class A fire and/or a Class B fire, may include a foam and one or more inert gases combined with the foam. For example, the foam may include a foam marketed by Tyco International Ltd. as "ANSUL TARGET-7®" foam. The use of other foam agents known to those having skill in the art is contemplated. Some embodiments may include foam agents that do not include foams based on fluorocarbon chemistry, such as, for example, AAAF-type foams. The one or more inert gases may include, for example, helium, neon, argon, krypton, xenon, and/or radon. For example, the fire extinguishing agent may include a conventional fire fighting foam gasified with, for example, helium and/or argon, although neon, krypton, and/or xenon may be included in the fire extinguishing agent.

The foam and the one or more inert gases may be combined via any method known to those having skill in the art, such as, for example, via combining in a nozzle of a fire extinguisher agent delivery apparatus and/or combining in a fire extinguisher agent mixing conduit. The fire extinguishing agent may be applied to a fire via any methods and/or devices known to those having skill in the art. According to some embodiments, the foam and the one or more inert gases may be combined in a ratio corresponding to about 60 gallons of foam-generating solution per 400 cubic feet of inert gas. Other ratios are contemplated.

Most classes of fires, including Class D fires, require fuel, an oxidizer, and heat in order to sustain combustion. Unlike most other classes of fires, however, Class D fires can sustain combustion by liberating necessary oxidizers from otherwise stable compounds, such as, for example, $CO_2$ and/or Halon®. Furthermore, unlike many common classes of fires, metal and/or metal compound fires may burn in oxidizers other than oxygen, such as, for example, chlorine, fluorine, and/or nitrogen. Class D fires, however, cannot burn in an inert atmosphere. The family of "true" inert or noble gases includes helium, neon, argon, krypton, xenon, and radon. Many of the inert gases may be currently thought to be too rare to be economically viable for use in a fire extinguishing agent. Further, radon is radioactive. As a result, helium and argon are two inert gases that currently appear to be desirable for use in a fire extinguishing agent according to some embodiments.

Attempting to extinguish fires including burning metal(s) and/or metal compound(s) (e.g., Class D fires) using one or more inert gases alone, however, may be very difficult. For example, attempting to use an inert gas alone to deprive such a fire of its oxidizer may not be effective because maintaining coverage may be difficult since helium is lighter than the surrounding atmosphere and will quickly float off, and argon is heavier than the surrounding air and will tend settle away from the area of deployment. Furthermore, the use of conventional foams to extinguish burning metal(s) and/or metal compound(s) has proven substantially ineffective, for example, because the water in the foam reacts with the metals to liberate hydrogen and because of the extreme heat of Class D fires, the fire's reaction will continue and use the air and/or nitrogen in the foam as an oxidizer, and the fire will continue to burn.

The combination of foam and inert gas may be effective because when water in the foam reacts with the metal, a hydroxide radical (not oxygen or any other oxidizer) is liberated during the reaction. Hydrogen is also liberated, but in the absence of an oxidizer (no air or nitrogen is used to generate the foam), the fire is starved out. The foam may serve to trap the inert gas and keep it positioned where it most effectively acts to extinguish the fire.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fire extinguishing agent comprising:

a foam; and at least one inert gas combined with the foam, wherein the at least one inert gas comprises at least one of helium, neon, argon, krypton, xenon, and radon, and wherein the fire extinguishing agent does not comprise any of the following: an oxidizer, hydrogen gas, nitrogen, carbon dioxide, halomethanes, fluorine, chlorine, and sulfur.

2. The fire extinguishing agent of claim 1, wherein the foam comprises a foam fire extinguishing agent.

3. The fire extinguishing agent of claim 1, wherein the fire extinguishing agent comprises a ratio of foam to inert gas of 60 gallons of foam-generating solution to 400 cubic feet of the inert gas.

4. The fire extinguishing agent of claim 1, wherein the at least one inert gas further comprises a concentration of the at least one inert gas greater than concentrations naturally occurring in air.

5. A fire extinguishing agent comprising:

a foam fire extinguishing agent; and at least one inert gas combined with the foam such that the foam traps the inert gas within the foam, wherein the at least one inert gas comprises at least one of helium, neon, argon, krypton, xenon, and radon, and wherein the fire extinguishing agent does not comprise any of the following: an oxidizer, hydrogen gas, nitrogen, carbon dioxide, halomethanes, fluorine, chlorine, and sulfur.

6. The fire extinguishing agent of claim 5, wherein the fire extinguishing agent comprises a ratio of foam to inert gas of 60 gallons of foam-generating solution to 400 cubic feet of the inert gas.

7. The fire extinguishing agent of claim 5, wherein the at least one inert gas further comprises a concentration of the at least one inert gas greater than concentrations naturally occurring in air.

* * * * *